US005942709A

United States Patent [19]

Szalay

[11] Patent Number: 5,942,709

[45] **Date of Patent: *Aug. 24, 1999**

[54] AUDIO PROCESSOR DETECTING PITCH AND ENVELOPE OF ACOUSTIC SIGNAL ADAPTIVELY TO FREQUENCY

[75] Inventor: Andreas Szalay, Emmelshausen, Germany

[73] Assignees: Blue Chip Music GmbH, Halsenbach, Germany; Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,549

[22] Filed: Mar. 7, 1997

[30] Foreign Application Priority Data

Mar. 12, 1996 [JP] Japan ..... 8-083158

[51] Int. Cl.[6] ..... G10H 1/057

[52] U.S. Cl. ..... 84/616; 84/627; 84/654; 84/663; 84/738; 84/DIG. 9

[58] Field of Search ..... 84/616, 627, 654, 84/661, 663, 681, 699, 700, 702, 703, 736, 738, 742, DIG. 9

[56] References Cited

U.S. PATENT DOCUMENTS

| | | | |
|---|---|---|---|
| 4,044,204 | 8/1977 | Wolnowsky . | |
| 5,048,391 | 9/1991 | Uchiyama et al. . | |
| 5,121,669 | 6/1992 | Iba et al. . | |
| 5,202,528 | 4/1993 | Iwaooji . | |
| 5,321,200 | 6/1994 | Yamamoto . | |
| 5,519,166 | 5/1996 | Furuhashi et al. | 84/616 X |
| 5,519,167 | 5/1996 | Kunimoto et al. | 84/661 |

FOREIGN PATENT DOCUMENTS

| | | |
|---|---|---|
| 0 749 107 A2 | 12/1996 | European Pat. Off. . |
| WO 95/16984 | 6/1995 | WIPO . |

*Primary Examiner*—Stanley J. Witkowski
*Attorney, Agent, or Firm*—Graham & James LLP

[57] ABSTRACT

An audio apparatus extracts information of a musical performance from an acoustic signal having a frequency and an amplitude, which time-vary during the musical performance. In the audio apparatus, a filtering device has a plurality of filters which are set with different cutoff frequencies so as to pass different frequency ranges of the acoustic signal. A pitch detecting device is connected to the filtering device for processing the acoustic signal to detect therefrom a pitch. A controlling device operates according to the detected pitch fed back from the pitch detecting device for selecting one of the filters set with one of the different cutoff frequencies adapted to the pitch of the acoustic signal so that the pitch detecting device can detect the pitch based on the acoustic signal filtered by the selected filter. Further, the envelope detecting device has a plurality of envelope followers corresponding to the plurality of the filters. Each envelope follower processes the acoustic signal to extract therefrom an envelope representing a time-variation of the amplitude of the acoustic signal and containing an upward portion and a downward portion such that each envelope follower forms the downward portion by a given slope which matches the frequency range of the corresponding filter.

19 Claims, 6 Drawing Sheets

AUDIO PROCESSOR DETECTING PITCH AND ENVELOPE OF ACOUSTIC SIGNAL ADAPTIVELY TO FREQUENCY

BACKGROUND OF THE INVENTION

1. Field of the Invention

The present invention relates to an audio apparatus in which a pitch and a note-on/note-off event of musical sound are extracted from an acoustic signal to generate performance information such as a MIDI (Musical Instrument Digital Interface) message. More particularly, the invention relates to the audio apparatus suitable for obtaining the musical performance information from an acoustic signal having a wide frequency range.

2. Description of Related Art

It is widely practiced in the field of electronic musical instruments that acoustic vibrations produced by playing musical instruments such as stringed instruments, percussion instruments, and wind instruments are converted into electrical oscillation signals, from which performance information such as pitch information and note-on/note-off information is detected in realtime to form a MIDI message. Supplying this MIDI message to a tone generator of a synthesizer, for example, can reproduce in realtime a melody being performed by a player in desired tones with desired sound effects and desired accompaniments.

In the above-mentioned processing in which the pitch information and the note-on/note-off information are detected from the electrical oscillation signal, the inputted electrical oscillation signal is first converted into a corresponding digital signal. Then, a frequency spectrum of the digital signal is limited by a lowpass filter. Zero cross points of instantaneous values of the filtered digital signal are analyzed for pitch detection. An amplitude envelope of the filtered digital signal is detected by an envelope follower. The envelope follower detects an upward or attack portion of the filtered signal, and then forms a downward or decay portion of an envelope waveform by a predetermined slope. Then, a level of the amplitude envelope detected by the envelope follower is compared with a predetermined threshold for determination of a note-on or note-off event.

For reliable detection of the above-mentioned pitch information and note-on/note-off information, a cutoff frequency of the lowpass filter and the slope of the envelope waveform at the decay portion formed by the envelope follower must be set to adapt to the basic frequency of the electrical oscillation signal. However, a practical frequency band of the lowpass filter is limited in which the reliable pitch detection is allowed. The frequency band of the lowpass filter can be tuned according to the cutoff frequency. The practical frequency band is limited to at most about two octaves for the following reasons. First, if the frequency of the inputted acoustic signal goes too low relative to the cutoff frequency, a harmonic frequency component increases excessively to frequently cause erroneous or false zero crosses due to the harmonic frequency component in addition to true zero crosses due to the basic frequency component, thereby disabling the reliable pitch detection. Second, if the frequency of the inputted acoustic signal goes too high relative to the cutoff frequency, the basic frequency components is also cut off, thereby disabling the reliable pitch detection.

Also, a practical frequency band is limited in which the reliable note-on/note-off detection is ensured at the predetermined slope of the envelope waveform of the decay portion. The practical frequency band is limited for the following reasons. First, as shown in FIG. 6(A), if the frequency of the inputted acoustic signal F stays too slow relative to the slope S of the decay portion of the envelope waveform, the envelope level falls below a threshold of note-off in timing t1 at which the amplitude of the acoustic signal F does not yet fall below the note-off threshold, resulting in erroneous detection of the note-off event. Further, at timing t2 in which the instantaneous value of the acoustic signal F rises above a threshold of note-on, this is detected as a rising or attack edge of a next envelope, resulting in erroneous detection of a note-on event. Second, as shown in FIG. 6(B), if the frequency of the inputted acoustic signal F stays too fast relative to the slope S of the decay portion of the envelope waveform, the envelope level does not fall below a threshold of note-off even when timing t3 comes at which the amplitude of the acoustic signal F actually falls below the note-off threshold, thereby failing to detect a true note-off event. Further, at timing t4 in which the acoustic signal F again rises, an attack portion of a next envelope is not detected since the preceding decay portion is not detected, thereby disabling the detection of the note-on event at that rising edge.

The limitation of the practical frequency band in which the reliable pitch detection and note-on/note-off detection are enabled at a predetermined cutoff frequency and a predetermined slope of the envelope waveform of the decay portion will present no substantial problem, if the performance information is to be extracted by multichannel from a polyphonic musical instrument such as a stringed instrument having a plurality of strings. As for a guitar for example, the frequency band of the acoustic vibration of each of six strings stays within two octaves, thereby enabling the correct pitch detection and correct note-on/note-off detection for all frequency bands of the respective strings by means of the multichannel processing.

However, in detection of the performance information by a single channel from a monophonic instrument such as a wind instrument, the frequency band varies over two octaves in general, thereby disabling the correct pitch detection and the correct note-on/note-off detection in some frequency ranges of that instrument.

SUMMARY OF THE INVENTION

It is therefore an object of the present invention to provide a performance information detecting apparatus capable of providing correct pitch information and correct note-on/note-off information from an acoustic signal having a wide frequency range.

In carrying out the invention, according to one aspect thereof, there is provided a performance information detecting apparatus practiced as a first preferred embodiment of the present invention comprising a pitch detector for capturing an acoustic signal in the form of an electrical oscillation signal to detect a pitch thereof, an envelope detector for capturing the electrical oscillation signal to detect an amplitude envelope thereof, the envelope detector being capable of adjusting a slope of the envelope at a decay portion, and a controller for variably controlling the slope of the envelope at the decay portion formed by the envelope detector according to the detection results provided by the pitch detector.

As noted, the envelope detector is capable of adjusting the slope of the envelope waveform of the decay portion by feedback control. When the pitch of the acoustic signal is detected by the pitch detector, the slope of this envelope waveform is variably controlled by the controller according to the detection result. This allows the detection of the envelope in a reliable manner where the slope of the envelope waveform of the decay portion is adapted to a current pitch. Based on the thus obtained envelope information, correct note-on/note-off information can be obtained even from the acoustic signal which varies over a wide frequency range.

It should be noted that preferably a filter may be added for limiting the frequency range of the inputted electrical oscillation signal. The filter is adjustable in a cutoff frequency. Another controller may be further added for variably controlling the cutoff frequency in this filter according to the detection result provided by the pitch detector. This novel constitution ensures the reliable pitch detection with the cutoff frequency adapted to the current pitch, thereby providing correct pitch information from the acoustic signal having a wide frequency range.

The performance information or playing information detecting apparatus practiced as a second preferred embodiment of the present invention comprises a plurality of filters set to different cutoff frequencies respectively, a pitch detector for detecting the pitch of an inputted electrical oscillation signal, and a controller for selectively determining, according to the detection result provided by the pitch detector, one of the filters to be employed for the reliable detection of the pitch information from the electrical oscillation signal that passes the selected one of the plurality of the filters.

As noted, the plurality of the filters are set to the different cutoff frequencies, respectively. When the pitch of the acoustic signal that has passed any one of the filters is detected by the pitch detector, the controller selectively determines the optimal one of the filters to detect the reliable pitch information according to the detection result fed back by the pitch detector. This feedback arrangement utilizes the detection result as feedback control to provide the output pitch information for the acoustic signal that passes the selected one of the filters having a cutoff frequency adapted to the current pitch. Therefore, the correct pitch information can be obtained even from the acoustic signal having a wide frequency range. Further, the second preferred embodiment has no complicated circuit such as a cutoff-frequency adjustable filter, so that significantly decreased fabrication cost and simplified constitution of the apparatus will result. Further, in the second preferred embodiment, the filter selection allows very quick start of the pitch detection at the optimal cutoff frequency adapted to the current pitch by the feedback control.

More specifically, the playing information detecting apparatus practiced as the second preferred embodiment of the present invention has a plurality of filters set with cutoff frequencies tuned to different frequency ranges and a plurality of pitch detecting channels corresponding to the plurality of the filters for detecting a pitch of the acoustic signal that has passed the filters. In the playing information detecting apparatus, a mode setting device is provided for setting one of a first mode and a second mode. A controller is provided for inputting a polyphonic electrical oscillation signal into all of the plurality of filters, the polyphonic electrical oscillation signal having different frequency ranges matching the respective cutoff frequencies of the filters, if the first mode is set by the mode setting device. The controller inputs another monophonic electrical oscillation signal into any one of the plurality of the filters so as to detect pitch information. The detection result fed back by the pitch detecting channel corresponding to said one of the plurality of the filters is used to determine an optimal filter for the reliable pitch detecting, if the second mode is set by the mode setting device.

As noted, when the first mode is set by the mode setting device, the inputted polyphonic electrical oscillation signal has different frequency ranges matching the respective cutoff frequencies of each filter. For example, the polyphonic electrical oscillation signal is derived from concurrent vibrations of each string of a guitar, and is inputted into all of the filters. Consequently, each pitch of the polyphonic signal that has passed the respective filter is detected by each pitch detecting channel. This allows the parallel pitch detection by each pitch detecting channel during the playing of a polyphonic musical instrument such as a guitar.

On the other hand, if the second mode is set by the mode setting device, the controller inputs the monophonic electrical oscillation signal, for example, derived from the playing of a monophonic musical instrument and different from that inputted in the first mode, into any one of the filters to determine an optimal filter by feeding back the detection result provided by the pitch detecting channel corresponding to that one filter. In the above-mentioned second preferred embodiment, this feedback control allows the reliable pitch detection provided by a pitch detecting channel for the monophonic signal that passes the optimal filter which has the cutoff frequency adapted to the current frequency of the monophonic signal. Consequently, the correct pitch information can be obtained even from the monophonic signal having a wide frequency range derived from the playing of a monophonic musical instrument. Thus, according to the second preferred embodiment, the playing information detecting apparatus can be commonly used for both of the parallel pitch detection in multichannel for a polyphonic electrical oscillation signal derived by the playing of a polyphonic musical instrument and the correct single pitch detection of a monophonic electrical oscillation signal having a wide frequency range derived from the playing of a monophonic musical instrument or derived from the utterance of a voice.

Preferably, the second preferred embodiment has a plurality of envelope detectors for respectively detecting the amplitude envelopes of the inputted polyphonic electrical oscillation signal with the different slopes of the decay portion adapted to the different frequency variation ranges of the polyphonic signal. Otherwise, under the second mode, the above-mentioned controller selectively determines the optimal envelope detector according to the detection result fed back by any one of the envelope detectors when performing the filter switching. This feedback constitution ensures the reliable envelope detection by using the optimal one of the envelope detectors forming the slope of the envelope waveform of the decay portion adapted to the current pitch, thereby providing correct note-on/note-off information from the monophonic signal having a wide frequency range. Preferably, the cutoff frequency of each of the above-mentioned filters is set such that the frequency pass band allotted to one filter partially overlaps with the frequency pass band allotted to another filter. This constitution allows right selection of the optimum filter for which the current pitch is near the center of the frequency pass band from the plurality of the filters having the frequency pass bands which are different but partially overlapping, thereby providing more correct pitch information. Further, it is preferable for the second preferred embodiment to install a note detector for detecting note-on/note-off events based on the detection result provided by the above-mentioned envelope detector, in order to enable the above-mentioned controller to perform the switching control everytime a note-off event is detected by this note detector. This constitution allows stable pitch detection for the acoustic signal that passes a specific filter during an interval between a note-on event and a subsequent note-off event, thereby preventing the filter switching or selecting operation from interfering with the pitch detection of one note.

It should be noted that the first preferred embodiment and the second preferred embodiment reliably detect a pitch of a next note with the cutoff frequency adapted to the frequency of the acoustic signal according to the detected pitch of a previous note by feedback control. A difference of one octave or more takes place very seldom between the pitch of the current note and the following pitch of the next note. An abrupt pitch change will not occur exceeding two octaves or more. Therefore, the inventive feedback constitution can practically well work to detect the pitch correctly.

The above and other objects, features and advantages of the present invention will become more apparent from the accompanying drawings.

DETAILED DESCRIPTION OF PREFERRED EMBODIMENTS

Figure 1:
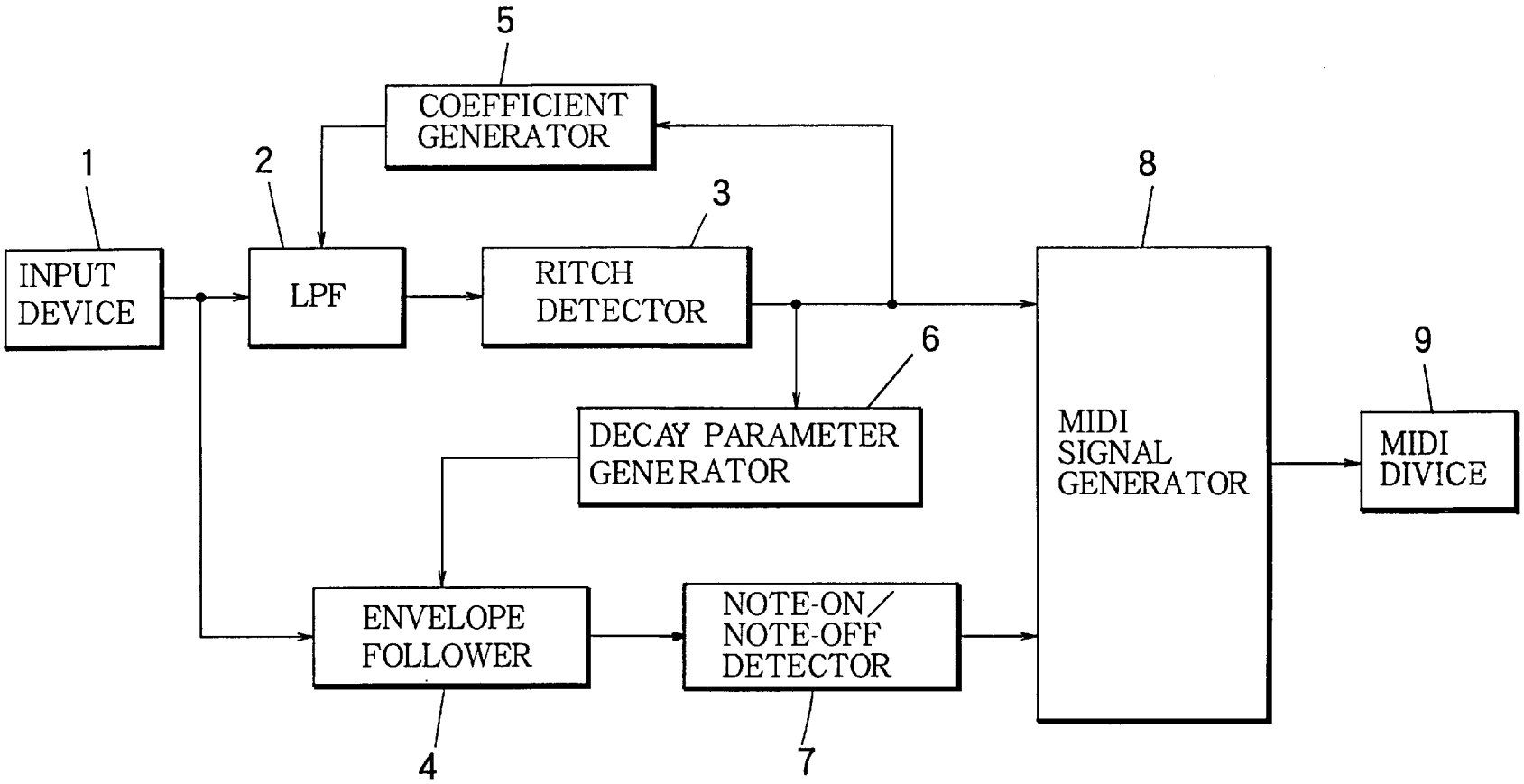
FIG. 1 is a block diagram illustrating an entire constitution of the playing information detecting apparatus practiced as a first preferred embodiment of the present invention.

This invention will be described in further detail by way of example with reference to the accompanying drawings. FIG. 1 shows a block diagram illustrating the entire constitution of the playing information detecting apparatus practiced as a first preferred embodiment of the present invention. An input device 1 converts an acoustic vibration generated by playing a monophonic musical instrument such as an acoustic wind instrument and an analog electrical musical instrument of a wind type or generated by utterance of a voice into an electrical analog oscillation signal, and further converts the analog oscillation signal into a corresponding digital signal. The acoustic signal outputted from the input device 1 is supplied to a lowpass filter (LPF) 2 and, at the same time, to an envelope follower 4.

The lowpass filter 2 can adjust a cutoff frequency thereof according to a filter coefficient supplied from a coefficient generator 5. The acoustic signal passes the filter 2 to limit a frequency range thereof, and is then supplied to a pitch detector 3. The pitch detector 3 detects a pitch of the supplied acoustic signal based on successive detection of zero cross points of instantaneous values of the acoustic signal. Such a pitch detection method is disclosed in U.S. patent application Ser. No. 08/662,474 and EP Application No. 96 109 542.9. The entire disclosure of these applications are incorporated herein by reference. The pitch information detected by the pitch detector 3 is supplied to a MIDI signal generator 8 and, at the same time, supplied to the coefficient generator 5 and a decay parameter generator 6. The coefficient generator 5 variably controls the cutoff frequency of the lowpass filter 2 to adapt the cutoff frequency to the current pitch by altering filter coefficients of the filter 2 based on the detected pitch by feedback control.

Figure 6A:
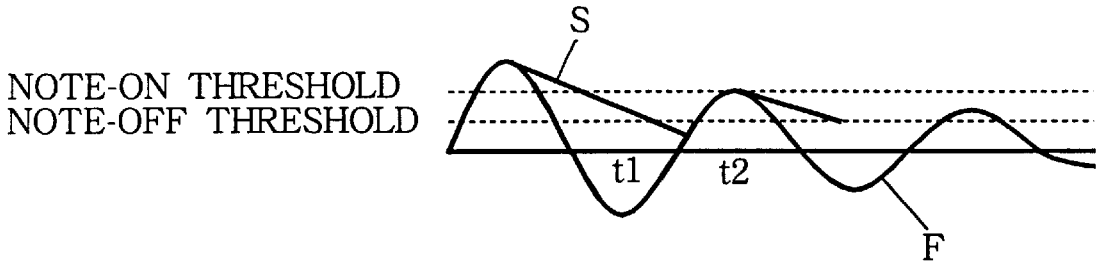
FIG. 6(A) and FIG. 6(B) are diagrams illustrating the relationship between an envelope waveform slope of a decay portion and a frequency of an acoustic signal.
Figure 6B:
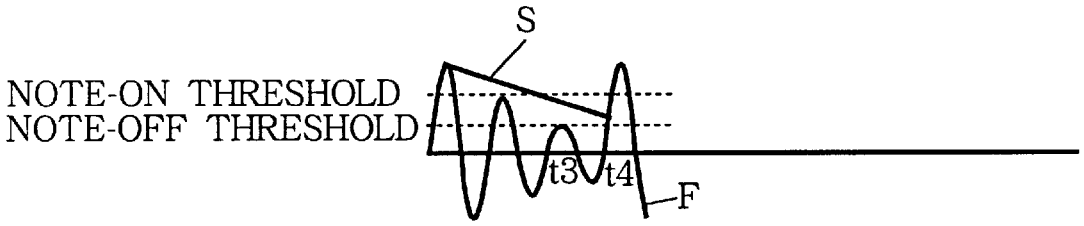
Figure 7:
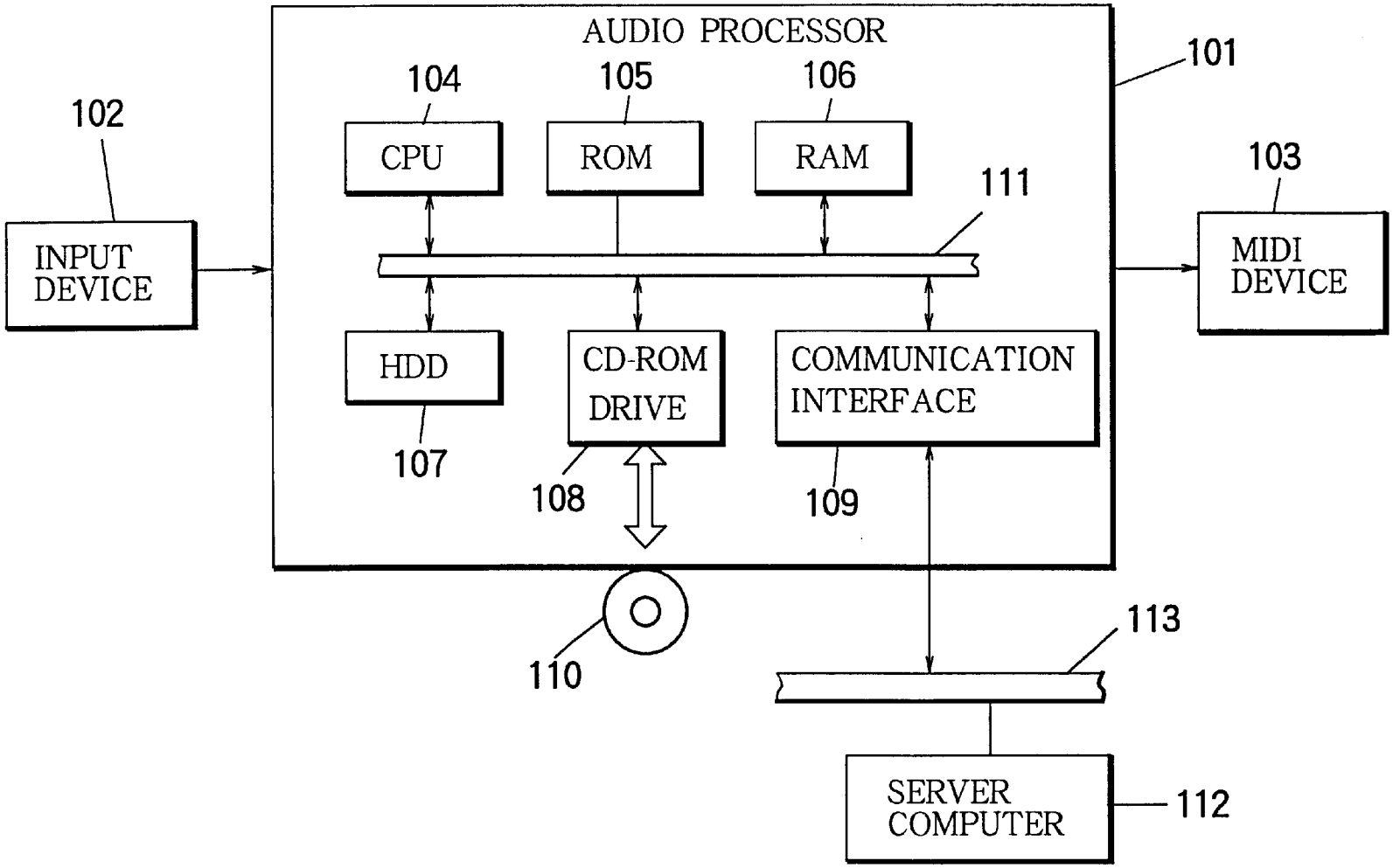
FIG. 7 is a block diagram showing an additional embodiment of the invention.

The envelope follower 4 detects an amplitude envelope of the supplied acoustic signal. After detecting the amplitude envelope of an attack or upward portion of the acoustic signal, the envelope follower 4 forms an envelope waveform of a decay or downward portion of the acoustic signal by a variable slope. This variable slope is adjustable based on a parameter supplied from the decay parameter generator 6. The envelope follower 4 basically operates in manner illustrated in FIGS. 6(A) and 6(B) to form the envelope of the decay portion. The decay parameter generator 6 variably controls the slope of the envelope waveform of the decay portion formed by the envelope follower 4 such that the slope is adapted to the current pitch by altering the decay parameter according to the pitch information supplied from the pitch detector 3.

The envelope information detected by the envelope follower 4 is supplied to a note-on/note-off detector 7. The note-on/note-off detector 7 performs note-on/note-off detection by comparing the level of the detected envelope with a predetermined threshold. The note event information detected by the note-on/note-off detector 7 is supplied to the MIDI signal generator 8. The MIDI signal generator 8 forms a MIDI message by use of the supplied pitch information and the note event information. The MIDI message outputted from the MIDI signal generator 8 is supplied to a MIDI device 9 such as a tone generator or a sound effector.

As described above, the first preferred embodiment can perform pitch detection and note-on/note-off detection with the adapted cutoff frequency of the lowpass filter 2 and the adapted slope of the envelope waveform of the decay portion formed by the envelope follower 4, thereby providing the reliable or correct pitch information and note-on/note-off information even from the monophonic acoustic signal having a wide frequency range.

Figure 2:
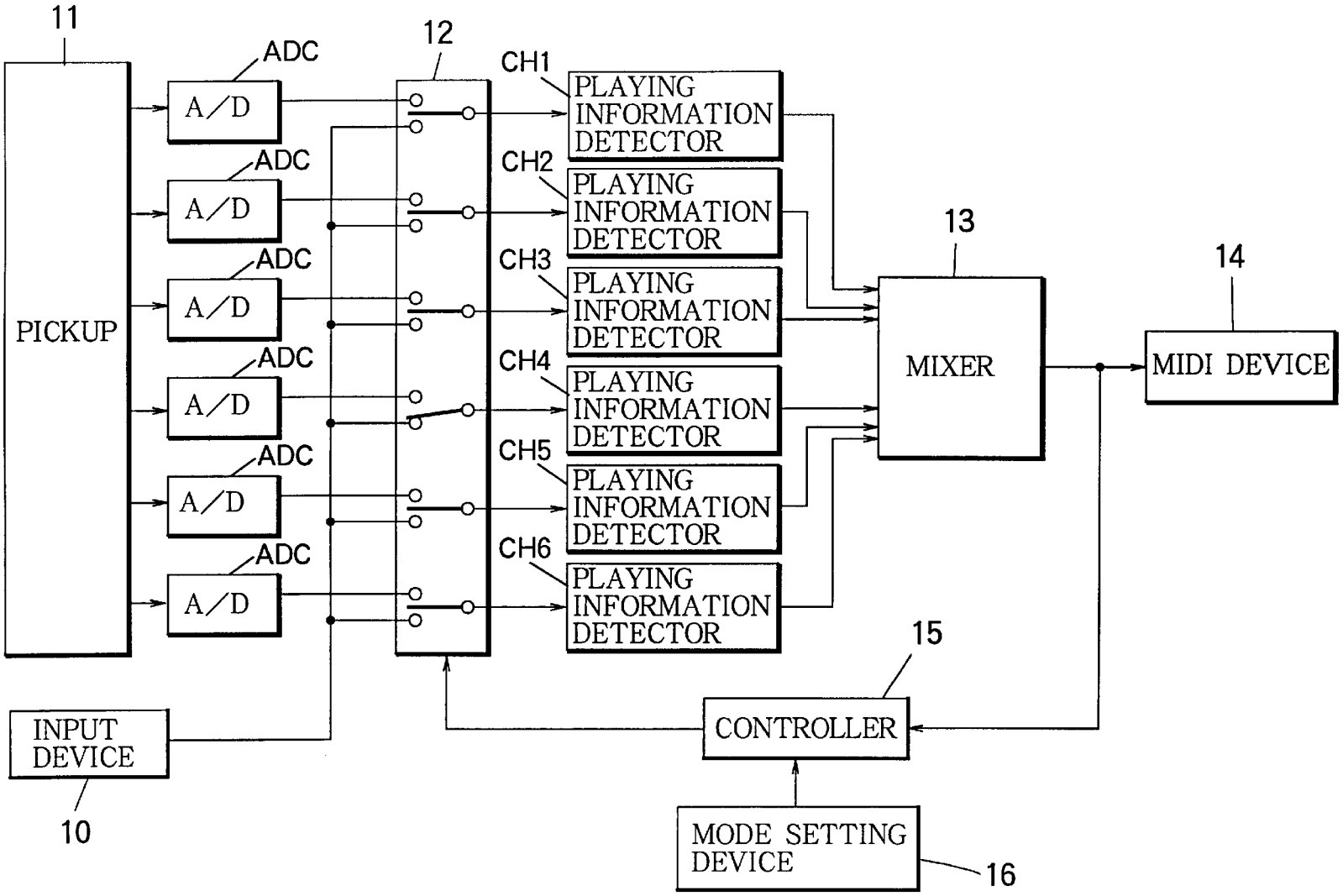
FIG. 2 is a block diagram illustrating an entire constitution of the playing information detecting apparatus practiced as a second preferred embodiment of the present invention.

For summary, according to the first embodiment, the inventive audio apparatus extracts information of a musical performance from an acoustic signal having a frequency and an amplitude, which time-vary during the musical performance. In the audio apparatus, the pitch detecting device (3) processes the acoustic signal to detect therefrom a pitch corresponding to the frequency of the acoustic signal. The envelope detecting device (4) processes the acoustic signal to detect therefrom an envelope representing a time-variation of the amplitude of the acoustic signal and containing an upward portion and a downward portion. The envelope detecting device (4) is controllable to form the downward portion by a variable slope. The controlling device (6) operates according to the detected pitch fed back from the pitch detecting device (3) for controlling the envelope detecting device (4) to adapt the variable slope of the downward portion to the frequency of the acoustic signal. The output device (8) outputs the information of the musical performance according to the pitch and the envelope having the adapted variable slope of the downward portion. Further, the filtering device (2) is controllable to filter the acoustic signal by a variable cutoff frequency so as to pass a desired frequency range of the acoustic signal to the pitch detecting device (3). The controlling device (5) operates according to the detected pitch fed back from the pitch detecting device (3) for controlling the filtering device (2) to adapt the variable cutoff frequency to the pitch of the acoustic signal, whereby the pitch detecting device (3) can detect the pitch based on the desired frequency range of the acoustic signal. FIG. 2 shows a block diagram illustrating entire constitution of the playing information detecting apparatus practiced as a second preferred embodiment of the present invention. An input device 10 is generally the same in constitution as the input device 1 shown in FIG. 1. A monophonic acoustic signal outputted from the input device 10 is supplied to all inputs of six paths of a selector 12.

A pickup 11 converts vibrations of six strings of an electric guitar or an acoustic guitar dedicated to a guitar synthesizer into polyphonic electrical analog oscillation signals corresponding to the six strings. The resultant analog signals are converted by A/D converters ADC into corresponding digital signals, which are supplied to the corresponding paths or terminals of the selector 12. The selector 12 has six paths corresponding to six number of playing information detecting channels CH1 through CH6, respectively. The selector 12 connects each playing information detecting channel to either of the input device 10 or the pickup 11 according to a control signal supplied from a controller 15.

Figure 3:
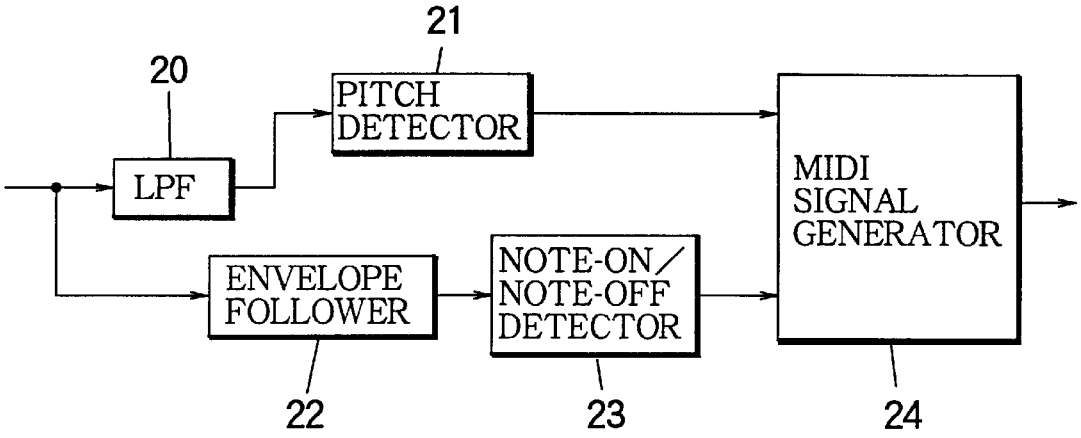
FIG. 3 is a block diagram illustrating an example of a playing information detecting channel installed in the embodiment of FIG. 2.

Each of the channels CH1 through CH6 is configured as shown in FIG. 3. The acoustic signal supplied from the selector 12 is fed to a lowpass filter (LPF) 20 and, at the same time, to an envelope follower 22. The cutoff frequency of the filter 20 is fixed. However, the cutoff frequency differs from channel to channel. Therefore, as will be described, the frequency band in which the correct pitch detection is ensured is determined by the cutoff frequency of the lowpass filter 20, and is different from channel to channel. The acoustic signal limited in a frequency range after the processing by the filter 20 is supplied to a pitch detector 21. The pitch detector 21 is generally the same in constitution as the pitch detector 4 shown in FIG. 1. The pitch information obtained by the pitch detector 21 is supplied to a MIDI signal generator 24.

Like the envelope follower 4 shown in FIG. 1, the envelope follower 22 detects the amplitude envelope of an attack portion of the inputted acoustic signal, and then forms the envelope waveform of the decay portion of the acoustic signal at a certain fixed slope. However, this slope differs from channel to channel. Therefore, as will be described, a frequency range in which correct envelope detection is ensured by this fixed slope of the envelope follower 22 differs from channel to channel. The envelope information detected by the envelope follower 22 is supplied to a note-on/note-off detector 23. The note-on/note-off detector 23 is generally the same in constitution as the note-on/note-off detector 7 shown in FIG. 1. The note event information detected by the note-on/note-off detector 23 is supplied to the MIDI signal generator 24. The MIDI signal generator 24 is also generally the same in constitution as the MIDI signal generator 8 shown in FIG. 1. A MIDI message generated by the MIDI signal generator 24 is mixed by a mixer 13 shown in FIG. 2 with MIDI messages supplied from the other channels, and is then supplied to a MIDI device 14 such as a tone generator or a sound effector and, at the same time, to the controller 15.

Figure 4:
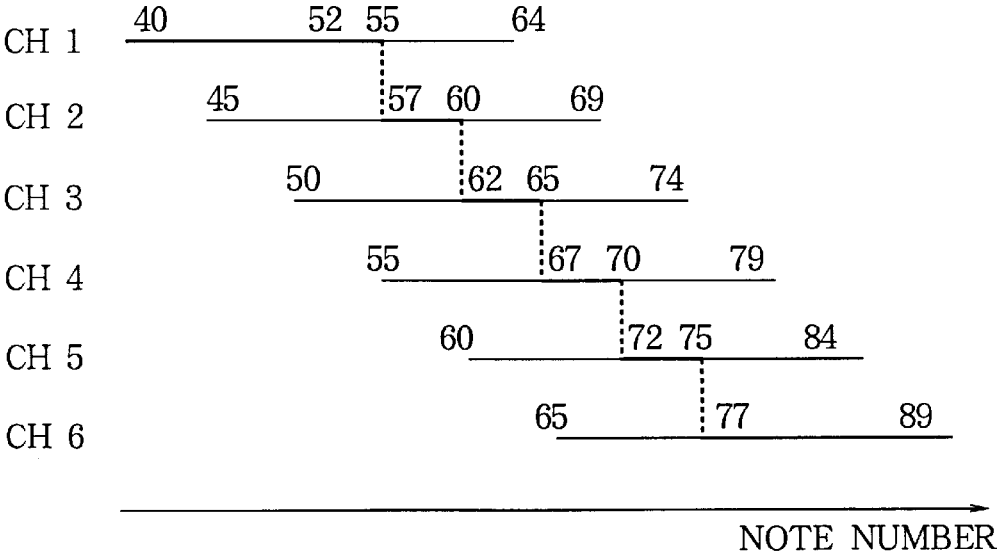
FIG. 4 is a diagram illustrating an example of frequency bands allotted to each playing information detecting channel.

FIG. 4 shows distribution of the different frequency bands in which correct pitch detection is enabled and which are determined by the cutoff frequencies of the lowpass filters 20 of the channels CH1 through CH6. In this example, the first frequency band in which the correct pitch detection is ensured is determined by the cutoff frequency of the filter 20 of the channel CH1 in a range of two octaves of 40 through 64 in terms of note number value. Therefore, the optimum frequency is 52 at the center of the range. The second frequency band in which correct pitch detection is ensured is determined by the cutoff frequency of the filter 20 of the channel CH2 in a range of two octaves of 45 through 69 in note number value. Therefore, the optimum frequency is 57 located at the center of the range. The third frequency band in which correct pitch detection is enabled is determined by the cutoff frequency of the filter 20 of the channel CH3 in a range of two octaves of 50 through 74 in note number value. Therefore, the optimum frequency is 62 at the center of the range. The fourth frequency band in which correct pitch detection is enabled is determined by the cutoff frequency of the filter 20 of the channel CH4 in a range of two octaves of 55 through 79 in note number value. Therefore, the optimum frequency is 67 at the center of the range. The fifth frequency band in which correct pitch detection is enabled is set by the cutoff frequency of the filter 20 of the channel CH5 within a range of two octaves of 60 through 84 in note number value. Therefore, the optimum frequency is 72 located at the center of the range. The sixth frequency band in which correct pitch detection is enabled is set by the cutoff frequency of the filter 20 of the channel CH6 in a range of two octaves of 65 through 89 in note number value. Therefore, the optimum frequency is 77 located at the center of the range. In other words, the cutoff frequency of the filter 20 of each channel is offset such that the respective frequency bands partially overlap with each other by note number value 19 between adjacent channels.

Also, the slope of the envelope waveform of the decay portion formed by the envelope follower 22 in each channel is set to a level adapted to the same frequency band as that of the corresponding filter 20.

Referring to FIG. 2 again, the controller 15 is provided with setting information indicating a first mode for detecting playing information based on the monophonic acoustic signal supplied from the input device 10. This mode is called a monophonic mode hereinafter. Otherwise, the setting information indicates a second mode for detecting playing information based on the polyphonic acoustic signal supplied from the pickup 11. This mode is called a polyphonic mode hereinafter. The first or second mode is selected by a mode selector switch or mode setting device 16 disposed on an operator panel. Based on the mode setting information, the controller 15 supplies a control signal to the selector 12, thereby controlling channel switching.

Figure 5:
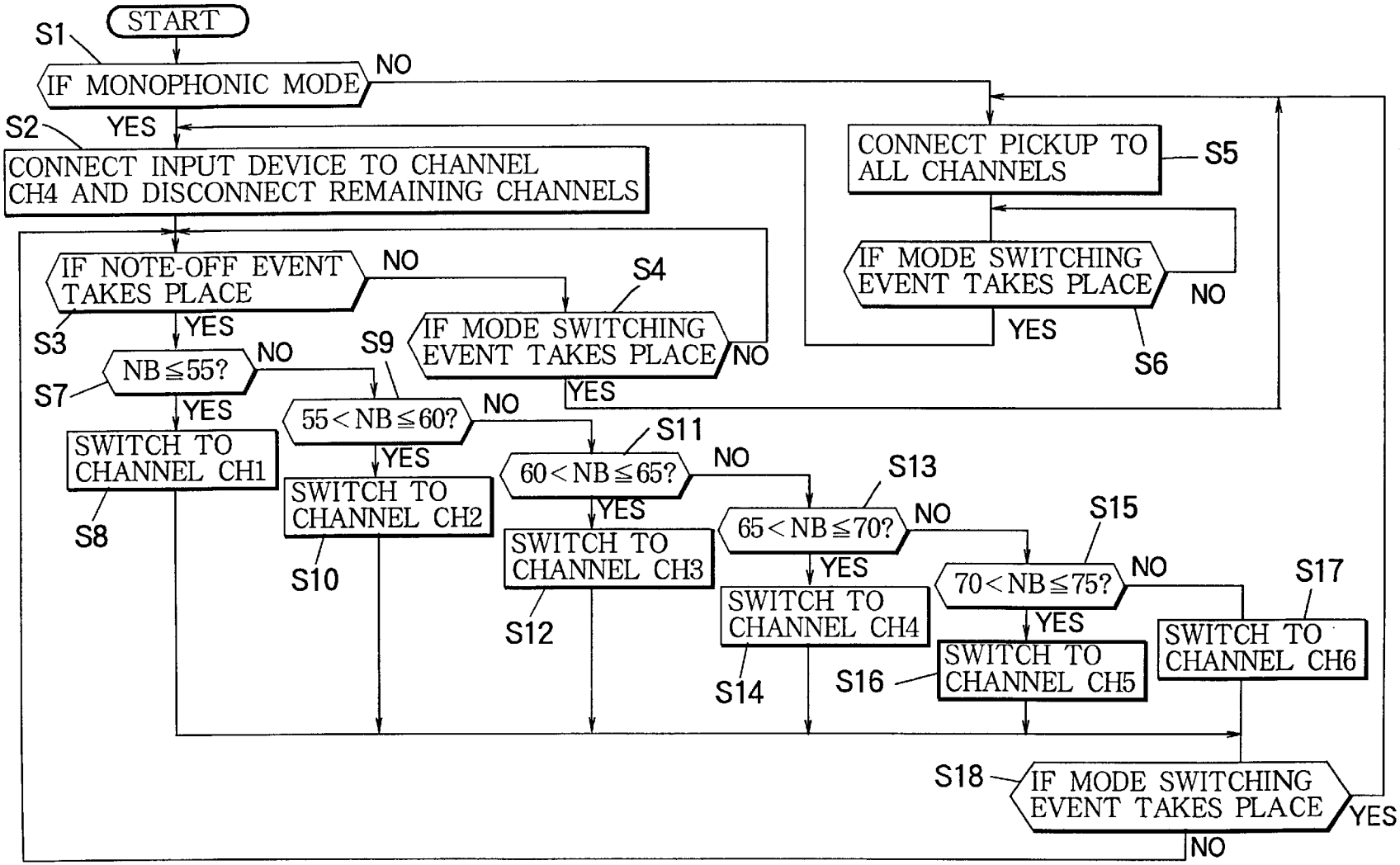
FIG. 5 is a flowchart illustrating switching control performed by a controller installed in the embodiment of FIG. 2.

FIG. 5 shows a flowchart describing the control for the above-mentioned channel switching. First, it is determined whether the currently set mode is the monophonic mode (step S1). If the decision is NO (namely, the currently set mode is the polyphonic mode), the process goes to step S5 to connect all of the channels CH1 through CH6 to the pickup 11. This causes the channels to form MIDI messages based on the playing of the guitar. The MIDI messages are mixed in the mixer 13 and are supplied to the MIDI device 14. Therefore, the second preferred embodiment can be functionally made as a part of a guitar synthesizer.

Then, in step S6, it is determined whether an event causing the mode switching takes place or not (namely, the monophonic mode is set or not). If the decision is NO, the step S6 will be repeated.

On the other hand, if the decision is YES in step S1, or if the decision is YES in step S6 after steps S1 and S5, the process goes to step S2 to connect a predetermined initial channel (for example, the middle channel CH4) to the input device 10. At the same time, all of the remaining channels are disconnected from the input device 10. This allows only the channel CH4 to form an initial MIDI message based on the playing of a monophonic musical instrument. The MIDI message is fed to the MIDI device 14 through the mixer 13. Thus, the playing information detecting apparatus can function as a part of a monophonic synthesizer.

Subsequently, check is made at step S3 as to whether the MIDI message fed back from the channel CH4 through the mixer 13 contains a note-off event. If NO, next check is made at step S4 as to whether a mode switching event takes place from the monophonic mode to the polyphonic mode. If YES, the routine jumps to step S5. Otherwise, if NO, the routine repeats the check at step S4.

On the other hand, if the check result of step S3 is YES, there is the note-off event so that the routine advances to step S7 where check is made as to whether a note number NB indicative of current pitch information contained in the MIDI message from the mixer 13 is not more than 55. As shown in FIG. 4, the NB value 55 is fairly greater than the central value 52 of the first frequency range allotted to the channel CH1. Therefore, the channel CH1 optimally adapts to the current pitch if the NB value is no more than 55. Consequently, the channel CH1 is connected to the input device 10 at step S8 if the check result of step S7 is YES. At the same time, the remaining channels are disconnected from the input device 10. Namely, the previously selected channel (for example, channel CH4) is switched to the channel CH1. Accordingly, the MIDI message is exclusively formed by the channel CH1 in response to the playing of the monophonic instrument.

If the decision of step S7 is NO, the process goes to step S9, in which it is determined whether the value of note number NB is higher than 55 and lower than 60. As shown in FIG. 4, since the range 55 through 60 covers the value 57 which is the middle value of the frequency band to which the channel CH2 is assigned, the channel CH2 is the optimum one for the current pitch if the same falls in the range 55–60. Consequently, if the decision is YES in step S9, the channel CH2 is connected to the input device 10 and, at the same time, all the remaining channels are disconnected in step S10. This allows only the channel CH2 to form a MIDI message based on the playing of the monophonic musical instrument.

If the decision is NO in step S9, the process goes to step S11, where it is checked whether the value of note number NB is higher than 60 and lower than 65. As shown in FIG. 4, since the window 60 through 65 includes the value 62 which is the middle value of the frequency band to which the channel CH3 is adapted, the channel CH3 is the optimum channel for the current pitch if the same falls in the window. Consequently, if the decision is YES in step S11, the channel CH3 is connected to the input device 10 and, at the same time, all the remaining channels are disconnected in step S12. This allows only the channel CH3 to form a MIDI message based on the playing of the monophonic musical instrument.

If the decision is NO in step S11, the process goes to step S13, in which it is determined whether the value of note number NB is higher than 65 and lower than 70. As shown in FIG. 4, since the window 65 through 70 covers the value 67 which is the middle value of the frequency band to which the channel CH4 is adapted, the channel CH4 is the optimum channel for the current pitch if the same falls within the window. Consequently, if the decision is YES in step S13, the channel CH4 is connected to the input device 10 and, at the same time, all the remaining channels are disconnected in step S14. This allows only the channel CH4 to form a MIDI message based on the playing of the monophonic musical instrument.

If the decision is NO in step S13, the process goes to step S15, in which it is determined whether the value of note number NB is higher than 70 and lower than 75. As shown in FIG. 4, since the window 70 through 75 covers the value 72 which is the middle value of the frequency band to which the channel CH5 is adapted, the channel CH5 is the optimum channel for the current pitch if the same falls in the window. Consequently, if the decision is YES in step S15, the channel CH5 is connected to the input device 10 and, at the same time, all the remaining channels are disconnected in step S16. This allows only the channel CH5 to form a MIDI message based on the playing of the monophonic musical instrument.

If the decision is NO in step S15, the value of note number NB is higher than 75. The value 75 is slightly lower than the value 77 which is the middle value of the frequency band to which the channel CH6 is adapted as shown in FIG. 4. The channel CH6 may be the optimum channel for the current pitch if the same exceeds the value 75. Consequently, the channel CH6 is connected to the input device 10 and, at the same time, all the remaining channels are disconnected in step S17. This allows only the channel CH6 to form a MIDI message based on the playing of the monophonic musical instrument.

When step S8, S10, S12, S14, S16, or S17 is completed, it is determined at step S18 as to whether an event for mode switching takes place indicating that the polyphonic mode is set. If the decision is YES, the process goes to step S5. If the decision is NO, the process goes back to step S3 to repeat the operations of step 3 and the subsequent steps.

The above-mentioned switching control allows the use of only one channel among the channels CH1 through CH6, that has the lowpass filter 20 set to the cutoff frequency optimum for the current pitch and has the envelope follower 22 with the slope of the envelope waveform of the decay portion set to the level optimum for the current pitch. The mode switching allows the present embodiment to use both of the multichannel pitch detection of an electrical oscillation signal originating from the guitar playing and the single channel pitch detection of another electrical oscillation signal originating from the monophonic instrument playing or the voice utterance.

In the monophonic mode, the use of the optimum playing information detecting channel selected by feedback of the current pitch provides the reliable or correct pitch information and the note-on/note-off information for the acoustic signal having a wide frequency range. Because the channel switching is performed whenever a note-off event takes place, continuous pitch detection by the selected channel is ensured during an interval from a note-on event to a subsequent note-off event. This prevents the channel switching from interfering with the pitch detection.

Further, unlike the first preferred embodiment, the second preferred embodiment has no complicated circuit such as a lowpass filter having an adjustable cutoff frequency and an envelope follower having an adjustable decay slope. Thus, the audio processor apparatus is less costly and simpler in constitution. The second preferred embodiment can start the pitch detection very quickly with the cutoff frequency adapted to the current pitch by the channel switching operation. It takes a transient time in the first preferred embodiment for the cutoff frequency to be stabilized after the filter coefficient alteration, causing a delay by that amount of the transient time.

It should be noted that, in the second preferred embodiment, each of the channels CH1 through CH6 is usually set to a different MIDI channel in the polyphonic mode. Therefore, if this setting is left unchanged when the monophonic mode is set, MIDI messages are outputted from different MIDI channels depending on ranges. Therefore, when the monophonic mode is set, all the channels CH1 through CH6 may be reset to one MIDI channel, thereby outputting the MIDI message from the single MIDI channel regardless of the frequency ranges.

In the second preferred embodiment, the channel CH4 is set as the initial channel. It will be apparent that any channel may be specified as the initial channel depending on a music piece according to input operation made on the operator panel by a player.

In the second preferred embodiment, each channel is constituted by hardware circuitry. It will be apparent that a software program prescribing the processing of the playing information detection may be executed by the CPU for each channel.

In the second preferred embodiment, channel selection is performed by the selector provided on the input side of each channel. It will be apparent that the selector may be provided on the output side of each channel for the channel selection.

In the second preferred embodiment, the channel switching is performed everytime a note-off event takes place. It will be apparent that the channel switching may be performed upon starting of the processing for forcibly lowering a volume of a current note if a next note event takes place before a note-off event of the current note takes place.

In the second preferred embodiment, the channel switching is performed everytime a note-off event takes place. It will be apparent that the channel switching may be performed after elapsing of a predetermined time subsequent to the note-off event. It will be also apparent that, instead of using a note-off event, the channel switching may be performed after elapsing of a predetermined time subsequent to a note-on event or when a volume level drops below a predetermined value.

In the second preferred embodiment, either of the polyphonic mode for detecting the performance information based on guitar playing or the monophonic mode for detecting the performance information based on monophonic instrument playing is selected. It will be apparent that the performance information may be detected based only on the monophonic instrument playing.

The second preferred embodiment has the six playing information detecting channels. It will be apparent that any number of channels other than 6 may be provided.

For summary, according to the second embodiment of the invention, the audio apparatus extracts information of a musical performance from an acoustic signal having a frequency and an amplitude, which time-vary during the musical performance. In the audio apparatus, the filtering device has a plurality of filters (20) which are set with different cutoff frequencies so as to pass different frequency ranges of the acoustic signal. The pitch detecting device has a plurality of detector channels (21) connected to corresponding ones of the filters (20) for processing the acoustic signal to detect therefrom a pitch. The mode setting device (16) sets either of a polyphonic mode where a plurality of acoustic signals having different frequencies are inputted in parallel to one another and a monophonic mode where a single acoustic signal is inputted. The controlling device (15) operates under the polyphonic mode for distributing the plurality of the acoustic signals to corresponding ones of the filters (20) according to the different frequencies of the acoustic signals. Otherwise, the controlling device (15) operates under the monophonic mode according to the detected pitch fed back from the pitch detecting device (21) for selecting one of the filters (20) set with one of the different cutoff frequencies adapted to the frequency of the single acoustic signal so that the pitch detector (21) corresponding to the selected filter (20) can detect the pitch of the acoustic signal filtered by the selected filter (20). The output device (13) outputs the information of the musical performance according to the pitch detected by the pitch detecting device (21). Further, the envelope detecting device has a plurality of envelope followers (22) corresponding to the plurality of the filters (20). Each envelope follower (22) processes the acoustic signal to detect therefrom an envelope representing a time-variation of the amplitude of the acoustic signal and containing an upward portion and a downward portion such that each envelope follower (22) forms the downward portion by a given slope which matches the frequency range of the corresponding filter (20). The controlling device (15) operates under the monophonic mode for selecting one of the envelope followers (22) corresponding to the selected filter (20) so that the selected envelope follower (22) can form the envelope having the downward portion of the given slope adapted to the frequency of the acoustic signal. The output device (13) operates under the monophonic mode for outputting the information of the musical performance according to the pitch and the envelope having the adapted variable slope of the downward portion. The output device (13) outputs the information of the musical performance in terms of a note-on event corresponding to the upward portion of the envelope and a note-off event corresponding to the downward portion of the envelope. The controlling device (15) selects one of the filters (20) and the corresponding one of the envelope followers (22) whenever the note-off event is outputted. The plurality of the filters (20) are set with the different cutoff frequencies such that the different frequency ranges of the acoustic signal passed by the respective filters (20) partially overlap with one another.

FIG. 6 shows an additional embodiment of the inventive audio processing apparatus. An audio processor 101 is connected between an input device 102 and a MIDI device 103 for processing an acoustic signal inputted by the input device 102 to detect a pitch and an envelope so as to produce performance information which is outputted to the MIDI device 103. The audio processor 101 is implemented by a personal computer composed of CPU 104, ROM 105, RAM 106, HDD (hard disk drive) 107, CD-ROM drive 108, and communication interface 109. The storage such as ROM 105 and HDD 107 can store various data and various programs including an operating system program and an application program which is executed to produce the performance information. Normally, the ROM 105 or HDD 107 provisionally stores these programs. However, if not, any program may be loaded into the audio processor 101. The loaded program is transferred to the RAM 106 to enable the CPU 104 to operate the inventive system of the audio processor 101. By such a manner, new or version-up programs can be readily installed in the system. For this purpose, a machine-readable media such as a CD-ROM (Compact Disc Read Only Memory) 110 is utilized to install the program. The CD-ROM 110 is set into the CD-ROM drive 108 to read out and download the program from the CD-ROM 108 into the HDD 107 through a bus 111. The machine-readable media may be composed of a magnetic disk or an optical disk other than the CD-ROM 110.

The communication interface 109 is connected to an external server computer 112 through a communication network 113 such as LAN (Local Area Network), public telephone network and INTERNET. If the internal storage does not reserve needed data or program, the communication interface 109 is activated to receive the data or program from the server computer 112. The CPU 104 transmits a request to the server computer 112 through the interface 109 and the network 113. In response to the request, the server computer 112 transmits the requested data or program to the audio processor 101. The transmitted data or program is stored in the storage to thereby complete the downloading.

The inventive audio processor 101 can be implemented by the personal computer which is installed with the needed data and programs. In such a case, the data and programs are provided to the user by means of the machine-readable media such as the CD-ROM 110 or a floppy disk. The machine-readable media contains instructions for causing the personal computer to perform the inventive method of extracting the performance information as described in conjunction with the previous embodiments.

For example, if the first embodiment of FIG. 1 is computerized as shown in FIG. 6, the machine readable media contains instructions for causing the computerized audio apparatus to perform the method of extracting information of a musical performance from an acoustic signal having a frequency and an amplitude, which time-vary during the musical performance. The method comprises the steps of processing the acoustic signal to detect therefrom a pitch corresponding to the frequency of the acoustic signal, processing the acoustic signal to detect therefrom an envelope representing a time-variation of the amplitude of the acoustic signal and containing an upward portion and a downward portion which is adaptively formed by a variable slope, adapting the variable slope of the downward portion to the frequency of the acoustic signal according to the detected pitch, and outputting the information of the musical performance according to the pitch and the envelope having the adapted variable slope of the downward portion.

If the second embodiment of FIGS. 2 and 3 is computerized as shown in FIG. 6, the machine readable media contains instructions for causing the computerized audio apparatus to perform the method of extracting information of a musical performance from an acoustic signal having a frequency and an amplitude, which time-vary during the musical performance. The method comprises the steps of filtering the acoustic signal through one of a plurality of filters (20) which are set with different cutoff frequencies so as to pass one of different frequency ranges of the acoustic signal, providing a plurality of detector channels (21) connected to corresponding ones of the filters (20) for processing the filtered acoustic signal to detect therefrom a pitch, setting either of a polyphonic mode where a plurality of acoustic signals having different frequencies are inputted in parallel to one another and a monophonic mode where a single acoustic signal is inputted, distributing the plurality of the acoustic signals under the polyphonic mode to corresponding ones of the filters (20) according to the different frequencies of the acoustic signals, otherwise distributing the single acoustic signal under the monophonic mode according to the detected pitch to a selected one of the filters (20) having one of the different cutoff frequencies matching the frequency of the single acoustic signal so that the pitch detector (21) corresponding to the selected filter (20) can detect the pitch of the acoustic signal filtered by the selected filter (20), and outputting the information of the musical performance according to the detected pitch.

As described and according to the playing information detecting apparatus associated with the invention, correct pitch information and correct note-on/note-off information can be obtained from an electrical oscillation signal having a wide frequency range and originating from monophonic musical instrument playing or voice utterance. Especially, according to the second preferred embodiment of the invention, the detection of the pitch information and the note-on/note-off information can be realized less costly with a simpler circuit constitution. The inventive apparatus can very quickly start the pitch detection at a cutoff frequency adapted to a current pitch. While the preferred embodiments of the present invention have been described using specific terms, such description is for illustrative purposes only, and it is to be understood that changes and variations may be made without departing from the spirit or scope of the appended claims.

What is claimed is:

1. An audio apparatus for extracting information of a musical performance from an acoustic signal having a frequency and an amplitude, which time-vary during the musical performance, comprising:

a pitch detecting device that detects from the acoustic signal a pitch corresponding to the frequency of the acoustic signal;

an envelope detecting device that detects from the acoustic signal an envelope representing a time-variation of the amplitude of the acoustic signal and containing an upward portion and a downward portion, the envelope detecting device being controllable to form the downward portion by a variable slope;

a controlling device that controls, according to the detected pitch fed back from the pitch detecting device, the envelope detecting device to adapt the variable slope of the downward portion to the frequency of the acoustic signal; and an output device that outputs the information of the musical performance according to the pitch and the envelope having the adapted variable slope of the downward portion.

2. An audio apparatus according to claim 1, further comprising a filtering device that is controllable to filter the acoustic signal by a variable cutoff frequency and that consequently passes a desired frequency range of the acoustic signal to the pitch detecting device, and another controlling device that controls, according to the detected pitch fed back from the pitch detecting device, the filtering device to adapt the variable cutoff frequency to the pitch of the acoustic signal, whereby the pitch detecting device can detect the pitch based on the desired frequency range of the acoustic signal.

3. An audio apparatus for extracting information of a musical performance from an acoustic signal having a frequency and an amplitude, which time-vary during the musical performance, comprising:

a filtering device that has a plurality of filters which are set with different cutoff frequencies to pass different frequency ranges of the acoustic signal;

a pitch detecting device that is connected to the filtering device for detecting a pitch from the acoustic signal;

a controlling device that selects, according to the detected pitch fed back from the pitch detecting device, one of the filters set with one of the different cutoff frequencies adapted to the pitch of the acoustic signal so that the pitch detecting device can detect the pitch based on the acoustic signal filtered by the selected filter; and an output device that outputs the information of the musical performance according to the pitch detected by the pitch detecting device.

4. An audio apparatus according to claim 3, further comprising an envelope detecting device that has a plurality of envelope followers corresponding to the plurality of the filters, each envelope follower processing the acoustic signal to extract therefrom an envelope representing a time-variation of the amplitude of the acoustic signal and containing an upward portion and a downward portion such that each envelope follower forms the downward portion by a given slope which matches the frequency range of the corresponding filter; wherein the controlling device selects one of the envelope followers corresponding to the selected filter so that the selected envelope follower can generate the envelope having the downward portion of the given slope adapted to the frequency of the acoustic signal, and wherein the output device outputs the information of the musical performance according to the pitch and the envelope having the adapted variable slope of the downward portion.

5. An audio apparatus according to claim 4, wherein the output device outputs the information of the musical performance in terms of a note-on event corresponding to the upward portion of the envelope and a note-off event corresponding to the downward portion of the envelope, and the controlling device selects one of the filters and the corresponding one of the envelope followers whenever the note-off event is outputted.

6. An audio apparatus according to claim 3, wherein the plurality of the filters are set with the different cutoff frequencies such that the different frequency ranges of the acoustic signal passed by the respective filters partially overlap with one another.

7. An audio apparatus for extracting information of a musical performance from an acoustic signal having a frequency and an amplitude, which time-vary during the musical performance, comprising:

a filtering device that has a plurality of filters which are set with different cutoff frequencies so as to pass different frequency ranges of the acoustic signal;

a pitch detecting device that has a plurality of detector channels connected to corresponding ones of the filters for processing the acoustic signal to detect therefrom a pitch;

a mode setting device that sets either of a polyphonic mode where a plurality of acoustic signals having different frequencies are inputted in parallel to one another and a monophonic mode where a single acoustic signal is inputted;

a controlling device that operates under the polyphonic mode for distributing the plurality of the acoustic signals to corresponding ones of the filters according to the different frequencies of the acoustic signals, and otherwise operates under the monophonic mode according to the detected pitch fed back from the pitch detecting device for selecting one of the filters set with one of the different cutoff frequencies adapted to the frequency of the single acoustic signal so that the pitch detector corresponding to the selected filter can detect the pitch of the acoustic signal filtered by the selected filter; and an output device that outputs the information of the musical performance according to the pitch detected by the pitch detecting device.

8. An audio apparatus according to claim 7, further comprising an envelope detecting device that has a plurality of envelope followers corresponding to the plurality of the filters, each envelope follower processing the acoustic signal to detect therefrom an envelope representing a time-variation of the amplitude of the acoustic signal and containing an upward portion and a downward portion such that each envelope follower forms the downward portion by a given slope which matches the frequency range of the corresponding filter; wherein the controlling device operates under the monophonic mode for selecting one of the envelope followers corresponding to the selected filter so that the selected envelope follower can form the envelope having the downward portion of the given slope adapted to the frequency of the acoustic signal, and wherein the output device operates under the monophonic mode for outputting the information of the musical performance according to the pitch and the envelope having the adapted variable slope of the downward portion.

9. An audio apparatus according to claim 8, wherein the output device outputs the information of the musical performance in terms of a note-on event corresponding to the upward portion of the envelope and a note-off event corresponding to the downward portion of the envelope, and the controlling device selects one of the filters and the corresponding one of the envelope followers whenever the note-off event is outputted.

10. An audio apparatus according to claim 7, wherein the plurality of the filters are set with the different cutoff frequencies such that the different frequency ranges of the acoustic signal passed by the respective filters partially overlap with one another.

11. An audio apparatus for extracting information of a musical performance from an acoustic signal having a frequency and an amplitude, which time-vary during the musical performance, comprising:

pitch detecting means for processing the acoustic signal to detect therefrom a pitch corresponding to the frequency of the acoustic signal;

envelope detecting means for processing the acoustic signal to detect therefrom an envelope representing a time-variation of the amplitude of the acoustic signal and containing an upward portion and a downward portion, the envelope detecting means being controllable to form the downward portion by a variable slope;

controlling means operative according to the detected pitch fed back from the pitch detecting means for controlling the envelope detecting means to adapt the variable slope of the downward portion to the frequency of the acoustic signal; and output means for outputting the information of the musical performance according to the pitch and the envelope having the adapted variable slope of the downward portion.

12. An audio apparatus for extracting information of a musical performance from an acoustic signal having a frequency and an amplitude, which time-vary during the musical performance, comprising:

filtering means having a plurality of filters which are set with different cutoff frequencies so as to pass different frequency ranges of the acoustic signal;

pitch detecting means connected to the filtering device for processing the acoustic signal to detect therefrom a pitch;

controlling means operative according to the detected pitch fed back from the pitch detecting means for selecting one of the filters set with one of the different cutoff frequencies adapted to the pitch of the acoustic signal so that the pitch detecting means can detect the pitch based on the acoustic signal filtered by the selected filter; and output means for outputting the information of the musical performance according to the pitch detected by the pitch detecting means.

13. An audio apparatus for extracting information of a musical performance from an acoustic signal having a frequency and an amplitude, which time-vary during the musical performance, comprising:

filtering means having a plurality of filters which are set with different cutoff frequencies so as to pass different frequency ranges of the acoustic signal;

pitch detecting means having a plurality of detector channels connected to corresponding ones of the filters for processing the acoustic signal to detect therefrom a pitch;

mode setting means for setting either of a polyphonic mode where a plurality of acoustic signals having different frequencies are inputted in parallel to one another and a monophonic mode where a single acoustic signal is inputted;

controlling means operative under the polyphonic mode for distributing the plurality of the acoustic signals to corresponding ones of the filters according to the different frequencies of the acoustic signals, and otherwise being operative under the monophonic mode according to the detected pitch fed back from the pitch detecting means for selecting one of the filters set with one of the different cutoff frequencies adapted to the frequency of the single acoustic signal so that the pitch detector corresponding to the selected filter can detect the pitch of the acoustic signal filtered by the selected filter; and output means for outputting the information of the musical performance according to the pitch detected by the pitch detecting means.

14. A method of extracting information of a musical performance from an acoustic signal having a frequency and an amplitude, which time-vary during the musical performance, comprising the steps of:

processing the acoustic signal to detect therefrom a pitch corresponding to the frequency of the acoustic signal;

processing the acoustic signal to detect therefrom an envelope representing a time-variation of the amplitude of the acoustic signal and containing an upward portion and a downward portion which is adaptively formed by a variable slope;

adapting the variable slope of the downward portion to the frequency of the acoustic signal according to the detected pitch; and outputting the information of the musical performance according to the pitch and the envelope having the adapted variable slope of the downward portion.

15. A method of extracting information of a musical performance from an acoustic signal having a frequency and an amplitude, which time-vary during the musical performance, comprising the steps of:

filtering the acoustic signal through one of a plurality of filters which are set with different cutoff frequencies so as to pass one of different frequency ranges of the acoustic signal;

processing the filtered acoustic signal to detect therefrom a pitch;

selecting one of the filters according to the detected pitch such that the selected filter has one of the different cutoff frequencies matching the acoustic signal so that the pitch can be detected based on the acoustic signal filtered by the selected filter; and outputting the information of the musical performance according to the detected pitch.

16. A method of extracting information of a musical performance from an acoustic signal having a frequency and an amplitude, which time-vary during the musical performance, comprising the steps of:

filtering the acoustic signal through one of a plurality of filters which are set with different cutoff frequencies so as to pass one of different frequency ranges of the acoustic signal;

providing a plurality of detector channels connected to corresponding ones of the filters for processing the filtered acoustic signal to detect therefrom a pitch;

setting either of a polyphonic mode where a plurality of acoustic signals having different frequencies are inputted in parallel to one another and a monophonic mode where a single acoustic signal is inputted;

distributing the plurality of the acoustic signals under the polyphonic mode to corresponding ones of the filters according to the different frequencies of the acoustic signals;

otherwise distributing the single acoustic signal under the monophonic mode according to the detected pitch to a selected one of the filters having one of the different cutoff frequencies matching the frequency of the single acoustic signal so that the pitch detector corresponding to the selected filter can detect the pitch of the acoustic signal filtered by the selected filter; and outputting the information of the musical performance according to the detected pitch.

17. A machine readable media containing instructions for causing a computerized apparatus to perform a method of extracting information of a musical performance from an acoustic signal having a frequency and an amplitude, which time-vary during the musical performance, the method comprising the steps of:

processing the acoustic signal to detect therefrom a pitch corresponding to the frequency of the acoustic signal;

processing the acoustic signal to detect therefrom an envelope representing a time-variation of the amplitude of the acoustic signal and containing an upward portion and a downward portion which is adaptively formed by a variable slope;

adapting the variable slope of the downward portion to the frequency of the acoustic signal according to the detected pitch; and outputting the information of the musical performance according to the pitch and the envelope having the adapted variable slope of the downward portion.

18. A machine readable media containing instructions for causing a computerized apparatus to perform a method of extracting information of a musical performance from an acoustic signal having a frequency and an amplitude, which time-vary during the musical performance, the method comprising the steps of:

filtering the acoustic signal through one of a plurality of filters which are set with different cutoff frequencies so as to pass one of different frequency ranges of the acoustic signal;

processing the filtered acoustic signal to detect therefrom a pitch;

selecting one of the filters according to the detected pitch such that the selected filter has one of the different cutoff frequencies matching the acoustic signal so that the pitch can be detected based on the acoustic signal filtered by the selected filter; and outputting the information of the musical performance according to the detected pitch.

19. A machine readable media containing instructions for causing a computerized apparatus to perform a method of extracting information of a musical performance from an acoustic signal having a frequency and an amplitude, which time-vary during the musical performance, the method comprising the steps of:

filtering the acoustic signal through one of a plurality of filters which are set with different cutoff frequencies so as to pass one of different frequency ranges of the acoustic signal;

providing a plurality of detector channels connected to corresponding ones of the filters for processing the filtered acoustic signal to detect therefrom a pitch;

setting either of a polyphonic mode where a plurality of acoustic signals having different frequencies are inputted in parallel to one another and a monophonic mode where a single acoustic signal is inputted;

distributing the plurality of the acoustic signals under the polyphonic mode to corresponding ones of the filters according to the different frequencies of the acoustic signals;

otherwise distributing the single acoustic signal under the monophonic mode according to the detected pitch to a selected one of the filters having one of the different cutoff frequencies matching the frequency of the single acoustic signal so that the pitch detector corresponding to the selected filter can detect the pitch of the acoustic signal filtered by the selected filter; and outputting the information of the musical performance according to the detected pitch.

* * * * *